US006875837B2

(12) United States Patent
Isogawa et al.

(10) Patent No.: US 6,875,837 B2
(45) Date of Patent: Apr. 5, 2005

(54) COATED GOLF BALL

(75) Inventors: Kazuhiko Isogawa, Kobe (JP); Seiichiro Endo, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/650,920

(22) Filed: Aug. 29, 2003

(65) Prior Publication Data

US 2004/0043838 A1 Mar. 4, 2004

(30) Foreign Application Priority Data

Aug. 30, 2002 (JP) ..... 2002-253342

(51) Int. Cl.[7] ..... C08G 18/79
(52) U.S. Cl. ..... 528/67; 528/73; 473/377; 473/378
(58) Field of Search ..... 528/73, 67; 473/378, 473/377

(56) References Cited

U.S. PATENT DOCUMENTS 5,137,972 A * 8/1992 Cook ..... 525/123
6,018,012 A 1/2000 Crast et al.
6,096,851 A 8/2000 Maruoka et al.

* cited by examiner

*Primary Examiner*—Rachel Gorr
(74) *Attorney, Agent, or Firm*—Birch, Stewart, Kolasch & Birch, LLP

(57) ABSTRACT

The present invention provides a coated golf ball having good appearance, excellent durability after repeated hitting, excellent abrasion resistance after washing by brushing and excellent stain resistance with a grass. The present invention relates to a coated golf ball formed by applying a paint on the surface of a golf ball body, wherein the paint comprises polyol containing urethane polyol as a main material and polyisocyanate curing agent, and the curing agent comprises 25 to 35% by weight of isocyanurate polyisocyanate derived from hexamethylene diisocyanate, 25 to 35% by weight of biuret polyisocyanate derived from hexamethylene diisocyanate and 35 to 50% by weight of isocyanurate polyisocyanate derived from isophorone diisocyanate.

10 Claims, No Drawings

COATED GOLF BALL

This nonprovisional application claims priority under 35 U.S.C. § 119(a) on Patent Application No(s). 2002-253342 filed in JAPAN on Aug. 30, 2002, which is(are) herein incorporated by reference.

FIELD OF THE INVENTION

The present invention relates to a coated golf ball. More particularly, it relates to a coated golf ball having good appearance such that it is fashionable and has high elegance, and excellent durability after repeated hitting.

BACKGROUND OF THE INVENTION

There are many types of golf balls, such as solid golf balls (e.g. one-piece solid golf balls, two-piece solid golf balls, three-piece solid golf balls and the like) and thread-wound golf balls, and they are all supplied into the market in the form of a coated golf ball having a paint layer provided on the surface of the golf ball body. The paint layer is provided for the protection of the surface of the golf ball body or a marking provided thereon, for maintaining a white glossy appearance for a long period of time, or for improving abrasion resistance or scuff resistance against sand and the like during a bunker shot.

As a paint for golf balls, paint selected from the group consisting of urethane-based resin, polyester-based resin, epoxy-based resin, acrylic-based resin paint and the like have generally been used. The paint layer had excellent durability by coating the paint two or more times. In order to simplify the application process, it has been suggested to form the paint layer as only a single layer by using paint having excellent drying characteristics (Japanese Patent Kokai Publication Nos. 146930/1999, 51401/2000 and the like).

In Japanese Patent Kokai Publication No. 146930/1999, a golf ball paint comprising polyol containing urethane polyol as a main material and polyisocyanate as a curing agent is disclosed. In the golf ball paint, the equivalent ratio of isocyanate groups in the main material with respect to hydroxyl groups in the curing agent (NCO/OH) is within the range of 0.5 to 2.0, and the urethane polyol has a hydroxyl value of 55 to 130 mg KOH/g and weight-average molecular weight of not less than 4,000 to less than 10,000.

In Japanese Patent Kokai Publication No. 51401/2000, a golf ball comprising a polyurethane coating over the exterior surface is disclosed. The polyurethane coating includes a polyester polyol resin component and polyisocyanate component, and the polyester polyol resin component contains a neopentyl glycol resin.

However, golf balls for driving ranges are used such that they are repeatedly hit and washed. Therefore, it has been exactingly required for the paint of the golf balls to have excellent performance, such as impact resistance against repeated hitting, abrasion resistance after washing by brushing and stain resistance with respect to grass. Particularly, when the paint layer is formed into only a single layer, it is difficult to satisfy the entire performance requirements.

OBJECTS OF THE INVENTION

A main object of the present invention is to provide a coated golf ball having good appearance, excellent durability after repeated hitting, excellent abrasion resistance after washing by brushing and excellent stain resistance with respect to grass.

According to the present invention, the object described above has been accomplished by providing a coated golf ball formed by applying a paint on the surface of a golf ball body, and using the paint comprising polyol and polyisocyanate containing isocyanurate polyisocyanate derived from hexamethylene diisocyanate, biuret polyisocyanate derived from hexamethylene diisocyanate and isocyanurate polyisocyanate derived from isophorone diisocyanate in the specified amount respectively, thereby providing a coated golf ball having good appearance, excellent durability after repeated hitting, excellent abrasion resistance after washing by brushing and excellent stain resistance with respect to grass.

SUMMARY OF THE INVENTION

The present invention provides a coated golf ball formed by applying a paint on the surface of a golf ball body, wherein the paint comprises polyol containing urethane polyol as a main material and polyisocyanate curing agent, and the curing agent comprises 25 to 35% by weight of isocyanurate polyisocyanate derived from hexamethylene diisocyanate, 25 to 35% by weight of biuret polyisocyanate derived from hexamethylene diisocyanate and 35 to 50% by weight of isocyanurate polyisocyanate derived from isophorone diisocyanate.

In order to put the present invention into a more suitable practical application, it is desired that the paint be formed from the main material and curing agent such that an equivalent ratio (NCO/OH) of isocyanate group in the curing agent to hydroxyl group in the main material is within the range of 1.0 to 1.5; and the paint have a single-layered structure.

The term "golf ball body" as used herein refers to a golf ball itself before it is coated with paint, of which the surface portion has many dimples. The term "coated golf ball" as used herein refers to a golf ball having a paint layer obtained by coating a paint on the golf ball body.

DETAILED DESCRIPTION OF THE INVENTION

The golf ball of the present invention may be either solid golf balls, such as a one-piece golf ball, two-piece golf ball, and multi-piece golf ball represented by a three-piece golf ball, or thread wound golf balls.

In case of the solid golf ball, one-piece golf ball or a core used for solid golf (solid core) may be the same one that has been conventionally used, and may be obtained by mixing a rubber composition using a mixer such as a mixing roll, and then vulcanizing and press-molding under applied heat the rubber composition in a mold into a spherical form. The rubber composition comprises 10 to 60 parts by weight of a vulcanizing agent (crosslinking agent), for example, α,β-unsaturated carboxylic acid (such as acrylic acid, methacrylic acid, etc.) or mono or divalent metal salts, such as zinc or magnesium salts thereof, or a functional monomer such as trimethylolpropane trimethacrylate, or a combination thereof;

0.5 to 5 parts by weight of co-crosslinking initiator such as organic peroxides;

10 to 30 parts by weight of filler such as zinc oxide, barium sulfate and the like; and optionally antioxidant, based on 100 parts by weight of a base rubber such as polybutadiene. The vulcanization may be conducted, for example, by press molding in a mold at 130 to 240° C. and 2.9 to 11.8 MPa for 15 to 60 minutes. It is preferable for the surface of the resulting core to be buffed to improve the adhesion to the cover layer formed on the core. The solid core may have single-layered structure or multi-layered structure which has two or more layers.

The core for thread wound golf ball (thread wound core), which may be also the same one that has been conventionally used, comprises a center and a thread rubber layer formed by winding thread rubber in a stretched state around the center, wherein the center may be either liquid center or solid center formed from rubber composition. The thread rubber can be of the same kind, which has been conventionally used for the thread rubber layer of the thread wound golf ball. For example, the thread rubber can be obtained by vulcanizing a rubber composition prepared by formulating sulfur, a vulcanization aid, a vulcanization accelerator, an antioxidant and the like to a natural rubber or a blend rubber of the natural rubber and a synthetic polyisoprene. A thread-wound core can be produced by drawing the thread rubber about 1000% and winding it over the center. However, such solid and thread-wound cores are given by way of illustrative examples only, and the invention shall not be limited thereto.

The cover is then covered on the core. In the golf ball of the present invention, the cover may be formed from thermoplastic resin such as ionomer resin, balata or hard rubber and the like, which has been conventionally used for the cover of the golf ball. Preferred is ionomer resin, because the ionomer resin contains free carboxyl group, and the resulting golf ball having ionomer cover has excellent adhesion to the paint layer.

In the golf ball of the present invention, the cover composition may optionally contain pigments (such as titanium dioxide, etc.) and the other additives such as a dispersant, an antioxidant, a UV absorber, a photostabilizer and a fluorescent agent or a fluorescent brightener, etc., in addition to the above component, such as ionomer resin as long as the addition of the additives does not deteriorate the desired performance of the golf ball cover. If used, it is desired for the amount of the pigment to be within the range of 0.1 to 6 parts by weight, preferably 0.5 to 5 parts by weight, more preferably 1 to 4 parts by weight, based on 100 parts by weight of the base resin for the cover.

At the time of molding the golf ball body, many depressions called "dimples" are formed on the surface of the golf ball. Furthermore, paint finishing or marking with a stamp may be optionally provided after the golf ball body is molded.

The paint layer is then formed on the golf ball body. In the coated golf ball of the present invention, it is desired for the surface of the golf ball body to be moderately ground before coating a paint layer in order to improve the adhesion of the paint to the golf ball body.

As the paint used for the coated golf ball of the present invention, a two-component type urethane-based paint comprising a polyol as a main material and a polyisocyanate as a curing agent is used. The main component in the main material of the urethane-based paint is the polyol. In addition, the polyol component comprises the specified urethane polyol, which is described as follows.

The urethane polyol is synthesized by reaction between polyisocyanate and polyol. The polyisocyanate is not specifically limited as long as it has two or more isocyanate groups. Examples of the polyisocyanates include aliphatic, cycloaliphatic, aromatic diisocyanate and aromatic-aliphatic diisocyanate, such as hexamethylene diisocyanate (HDI), xylylene diisocyanate (XDI), hydrogenated xylylene diisocyanate ($H_6$XDI), isophorone diisocyanate (IPDI), tetramethyl xylylene diisocyanate (TMXDI), and hydrogenated diphenylmethane diisocyanate ($H_{12}$MDI). Preferred is non-yellowing polyisocyanate (i.e., aliphatic or cycloaliphatic polyisocyanate), because it exhibits high weather resistance.

Polyol used for preparing the urethane polyol is not specifically limited, and may be low-molecular weight polyol and high-molecular weight polyol as long as it has a plurality of hydroxyl groups. Examples of low-molecular weight polyols include: diols such as ethylene glycol, diethylene glycol, triethylene glycol, butylene glycol, 1,3-butanediol, 1,4-butanediol, neopentyl glycol, and 1,6-hexanediol; and triols such as glycerin, trimethylolpropane, and hexane triol. Examples of high-molecular weight polyols include: polyether polyol obtained by the reaction between an initiator having active hydrogen source and alkylene oxide; condensed polyester polyol obtained by the dehydration and condensation between dibasic acid such as adipic acid and glycol or triol; lactone-based polyester polyol obtained by the ring-opening polymerization of lactone such as ϵ-caprolactone; polycarbonate diol obtained from cyclic diol; and polymer polyol such as acrylic polyol obtained by properly introducing hydroxyl groups into acrylic copolymer. Examples of polyether polyols include polyethylene glycol, polypropylene glycol, polytetramethylene glycol and the like. Examples of condensed polyester polyols include polyethylene adipate and the like. Examples of lactone-based polyester polyol include poly-ϵ-caprolactone and the like.

Among the above-described polyol, preferable is polyol having a weight-average molecular weight (hereinafter, referred to as "Mw") of 50 to 2,000, and more preferably 100 to 1,000. The above-described polyol may be used alone or in combination of two or more thereof.

Urethane polyol is polyol having urethane bonds formed by the reaction between the above diisocyanate compound and polyol, and having hydroxyl groups as the terminal groups. It is desired that a content of the urethane bonds in the urethane polyol be within the range of 0.1 to 5 mmol/g, based on 1 g of the urethane polyol. The stiffness of the paint layer depends on the content of the urethane bonds. When the content of urethane bonds is smaller than 0.1 mmol/g, the concentration of the urethane in the paint layer is too small, and the scuff resistance is degraded. On the other hand, when the content of urethane bonds is larger than 5 mmol/g, the paint layer is too hard, and the paint layer does not sufficiently adapt to the deformation of the golf ball body. Therefore, the paint layer easily cracks.

In the paint of the present invention, it is desired for the urethane polyol to have Mw of from not less than 4,000 to less than 10,000, and more preferably from 4,500 to 9000. When the Mw is smaller than 4,000, the drying time of the paint layer is long, and the workability and productivity are degraded. On the other hand, when the Mw is not less than 10,000, which is high molecular weight, the hydroxyl value of the urethane polyol is relatively small, and the reactivity of the paint after applying is not sufficiently obtained. Therefore, the adhesion to the surface of the golf ball body is degraded. When the Mw is not more than 9,000, it is possible to form a dense paint layer having good adhesion to the surface of the golf ball body even in a wet condition.

In the paint of the present invention, it is desired for the urethane polyol to have a hydroxyl value of 15 to 130 mg KOH/g, and preferably 73 to 120 mg KOH/g. When the hydroxyl value is smaller than 15 mg KOH/g, the reactivity with the curing agent is not sufficiently obtained, and the adhesion to the surface of the golf ball body is degraded. On the other hand, when the hydroxyl value is larger than 130 mg KOH/g, the rate of the reaction with the curing agent is small, and the drying time is long, which degrades the productivity. In addition, the paint layer easily cracks.

The urethane polyol is synthesized by the following steps. Polyol as a raw material is diluted with solvent, and then is mixed with a reaction catalyst (for example, dibutyltin laurate). The polyisocyanate is slowly added to the mixture to form urethane bonds. The urethane polyol has hydroxyl group as a terminal group. The content of urethane bonds is determined by adjusting the molecular weight of raw material polyol, the mixing ratio between the polyol and polyisocyanate and the like.

Preferably, the polyol component of the paint of the present invention is the specified urethane polyol itself. That is, preferably, the main material is substantially the specified urethane polyol itself. However, the main material may contain polyol, which has no urethane bonds but is compatible with the urethane polyol, in addition to the urethane polyol.

The polyol other than the specified polyol may be selected from the polyols, which are used for synthesizing the urethane polyol, such as low molecular weight diol, triol, and polymer polyol. Concrete examples of the polyols include low molecular weight diol such as ethylene glycol, diethylene glycol, triethylene glycol, butylene glycol, 1,3-butane diol, 1,4-butane diol, neopentyl glycol, and 1,6-hexane diol; low molecular weight triol such as glycerin, trimethylol propane, and hexane triol; polyether polyol and condensed polyester polyol such as polyethylene glycol, polypropylene glycol, and polytetramethylene glycol; lactone-based polyester polyol; polycarbonate diol; acrylic polyol; and the like.

When the main material contains polyol having no urethane bonds, the content of the urethane polyol in the main material is preferably not less than 50% by weight, and more preferably 80% by weight. When the content of the urethane polyol in the main material contains is smaller than 50% by weight, the content of the urethane polyol is relatively small, and the drying time of the paint is long.

In the coated golf ball of the present invention, it is required for the curing agent used in the paint to comprise (a) 25 to 35% by weight of isocyanurate polyisocyanate derived from hexamethylene diisocyanate, (b) 25 to 35% by weight of biuret polyisocyanate derived from hexamethylene diisocyanate, and (c) 35 to 50% by weight of isocyanurate polyisocyanate derived from isophorone diisocyanate, based on the total weight of the curing agent. The amount of the component (a) is preferably 26 to 34% by weight, more preferably 27 to 33% by weight; the amount of the component (b) is preferably 26 to 34% by weight, more preferably 27 to 33% by weight; and the amount of the component (c) is preferably 37 to 48% by weight, more preferably 39 to 46% by weight, based on the total weight of the curing agent.

When the amount of the component (a) is smaller than 25% by weight, the paint layer is too soft, which degrades the abrasion resistance. On the other hand, when the amount of the component (a) is larger than 35% by weight, the compatibility with the main material is degraded, and the leveling of the paint layer is poor, which degrades the appearance.

When the amount of the component (b) is smaller than 25% by weight, the compatibility with the main material is degraded, and the leveling of the paint layer is poor, which degrades the appearance. On the other hand, when the amount of the component (b) is larger than 35% by weight, the amount of the isocyanurate polyisocyanate derived from isophorone diisocyanate is relatively small, and the stain resistance with a grass of the resulting paint layer is degraded.

When the amount of the component (c) is smaller than 35% by weight, the stain resistance with a grass of the resulting paint layer is degraded. On the other hand, when the amount of the component (c) is larger than 50% by weight, the paint layer is hard and brittle, and the impact resistance at the time of repeated hitting is degraded. In addition, the rate of curing reaction with the main material is large, and the pot life of the paint is short.

The paint is used after the main material and curing agent are mixed with each other immediately before applied to the golf ball body. The main material and curing agent are mixed such that the equivalent ratio (NCO/OH) of the isocyanate groups of the curing agent to the hydroxyl groups of the main material is 1.0 to 1.5, and preferably 1.1 to 1.4. When the equivalent ratio (NCO/OH) is smaller than 1.0, the curing agent is sticky, and dust and stain are easily stuck on the paint. On the other hand, when the equivalent ratio is larger than 1.5, the isocyanate groups remain, and the isocyanate groups is reacted with water to form $CO_2$, which occurs voids in the paint layer.

In the coated golf ball of the present invention, the paint may contain additives, diluent and the like in addition to the above components. Examples of the additives, which are generally contained in a paint for golf ball, include a UV absorber, an antioxidant, a photostabilizer, a silicon-based slipping agent, a leveling agent, a viscosity regulator, a fluorescent brightening agent, a blocking inhibitor, a curing catalyst and a color pigment, and the like. The additives may be added to the main material or the curing agent. The amount of the additives is preferably 0.1 to 10 parts by weight, based on 100 parts by weight of resin solid content in the paint.

The diluent used for the paint includes water; alcohols, such as isopropyl alcohol; aromatic hydrocarbons, such as toluene; aliphatic hydrocarbons, such as hexane; esters, such as ethyl acetate; ketones, such as methyl ethyl ketone; and the like. The diluent may be present in an amount of 5 to 50% by weight based on the solid content of the paint.

The paint may be applied on the cover surface of a two-piece golf ball including a rubber core and an ionomer cover covering the core and multi-piece golf ball; may be used as a primer paint applied on the surface of the core; or may be used as a clear coating for the surface of the core coated with the primer paint. The paint may be applied on the surface of a one-piece golf ball including a rubber core alone, a solid golf ball including a rubber core and an ionomer cover covering the core, and a thread-wound golf ball including a thread-wound core and a cover covering the thread-wound core.

The paint is applied on the golf ball body, of which the surface is pretreated by surface treatment, such as washing, after mixing the main material and the curing agent of the paint. The method of applying the paint is not specifically limited, but may be a conventional method for coating two-component type paint well known in the art, such as air gun spray coating, electrostatic coating and the like. When the paint is applied by coating with an air spray gun, the paint may be prepared by mixing a small amount of the main material and a small amount of the curing agent with each other; by continuously conveying the main material and the curing agent through their respective channels by their respective pumps to a mixer such as a static mixer provided immediately upstream of the spray gun to mix them with each other at a constant ratio in the mixer; or by mixing the main material and the curing agent with each other at a ratio controlled by a mixing ratio controller provided to the air spraying system.

Since there is almost no adverse influence on the physical properties of the ionomer cover and the rubber core, after being applied, it is desired for the paint to be dried and cured at a temperature lower than 50° C. for 0.5 to 2 hours. Thereby, it is possible to form a hard urethane-based paint layer without deteriorating the productivity and plasticizing the cover.

In the coated golf ball of the present invention, the paint layer may have single-layered structure or multi-layered structure, has two or more layers. It is preferable for the paint layer to have single-layered structure in view of the simplification of the applying process. In the paint used for the coated golf ball of the present invention, since the impact resistance and abrasion resistance are improved by using the components (a), (b) and (c) in specified amount as a curing agent, it is not necessary for the paint layer to have multi-layered structure, and it is accomplished to provide the coated golf ball having good appearance, excellent durability, excellent abrasion resistance and excellent stain resistance.

In the coated golf ball of the present invention, it is desired for the paint layer to have a thickness of 6 to 25 μm, preferably 8 to 20 μm. When the thickness of the paint layer is smaller than 6 μm, it is easy to wear off the paint layer during frequent use of the golf ball. On the other hand, when the thickness of the paint layer is larger than 25 μm, the technical effects accomplished by the presence of the dimples is not sufficiently obtained, and the flight performance of the resulting coated golf ball is degraded.

The weight of golf balls is limited to not more than 45.92 g in accordance with the regulations for large size golf balls, but the lower limit is not established. The golf ball of the present invention has a weight of 44.0 to 45.8 g, preferably 44.2 to 45.8 g. When the weight is smaller than 44.0 g, inertia of the golf ball on the fly is lost, and the golf ball stalls at the latter half flight period, which reduces the flight distance. On the other hand, when the weight is larger than 45.8 g, the shot feel is heavy and poor.

The golf ball of the present invention can have a diameter of 41.0 to 44.0 mm, but the diameter is preferably at least 42.67 mm in accordance with the regulations for large size golf balls, and the diameter is typically about 42.75 mm.

EXAMPLES

The following Examples and Comparative Examples further illustrate the present invention in detail but are not to be construed to limit the scope of the present invention.

Examples 1 to 5 and Comparative Examples 1 to 7

Production of Core

The rubber composition for the core having formulations shown in Table 1 was mixed, and press-molded at 160° C. for 13 minutes in a mold, which is composed of an upper mold and a lower mold having a semi-spherical cavity to obtain a spherical core having a diameter of 39.3 mm.

TABLE 1

| Core composition | Amount (parts by weight) |
|---|---|
| Polybutadiene *1 | 100 |
| Zinc oxide | 5.6 |
| Zinc acrylate | 22.0 |
| Calcium carbonate | 21.0 |
| Dicumyl peroxide | 1.85 |

*1: High-cis-polybutadiene, commercially available from JSR Co., Ltd. under the trade name of "BR-11"

Preparation of Cover Composition

The material having formulations shown in Table 2 was mixed using a kneading type twin-screw extruder to obtain pelletized cover composition. The extrusion condition was, a screw diameter of 45 mm, a screw speed of 200 rpm, and a screw L/D of 35.

The formulation material was heated at 200 to 260° C. at the die position of the extruder.

TABLE 2

| Cover composition | Amount (parts by weight) |
|---|---|
| Hi-milan 1605 *2 | 40 |
| Hi-milan 1706 *3 | 30 |
| Hi-milan 1707 *4 | 30 |
| Titanium oxide | 2 |

*2: Hi-milan 1605 (trade name), ethylene-methacrylic acid copolymer ionomer resin obtained by neutralizing with sodium ion, manufactured by Du Pont-Mitsui Polychemicals Co., Ltd.
*3: Hi-milan 1706 (trade name), ethylene-methacrylic acid copolymer ionomer resin obtained by neutralizing with zinc ion, manufactured by Du Pont-Mitsui Polychemicals Co., Ltd.
*4: Hi-milan 1707 (trade name), ethylene-methacrylic acid copolymer ionomer resin obtained by neutralizing with sodium ion, manufactured by Du Pont-Mitsui Polychemicals Co., Ltd.

Production of Golf Ball Body

The cover composition was covered on the resulting core by directly injection molding to form a cover layer and obtain a two-piece golf ball body having a diameter of 42.7 mm. The mold for molding the cover, which is composed of an upper mold and a lower mold, has a semi-spherical cavity, and the cavity has dimples, of which one part is movable and also functions as hold pin. The core was placed in the cavity of the mold, and was held by putting out the hold pin. Cover resin under applied heat to 210° C. was injected in the mold, which was closed at clamping pressure of 80 t, for 0.3 seconds, and was cooled for 30 seconds to open the mold, followed by taking out the golf ball body.

(Preparation of Urethane Polyol)

Polytetramethylene glycol (commercially available from Hodogaya Chemical Co., Ltd. under the trade name of "PTMG 650") was dissolved in solvent (toluene, methyl ethyl ketone), and then 0.1% by weight of dibutyltin laurate as a curing catalyst was added to the solution, based on the total weight of the main material. The resulting polyol solution was heated and kept at 80° C., to which 45% by weight of isocyanurate polyisocyanate derived from isophorone diisocyanate (commercially available from Sumitomo-Bayer Urethane Co., Ltd. under the trade name of "Desmodule Z-4370") was added dropwise, to synthesize urethane polyol (solid content: 60% by weight, average molecular weight: 7,900, hydroxyl value: 89 mg KOH/g).

(Coating of Paint)

The golf ball body was pretreated by grinding the surface thereof, and then marking printed with a pad stamp. The two-component type urethane clear paint obtained by mixing urethane polyol as a main material and the curing agent having the formulation shown in Tables 3 and 4 at an equivalent ratio (NCO:OH) of 1.2:1.0 was prepared. The paint was applied on the pretreated and printed golf ball body by air gun spray, and dried and cured at 40° C. for 60 minutes to obtain a coated golf ball. The resulting paint layer has a thickness of 10 $\mu$m. With respect to the resulting coated golf ball, the appearance, and the impact resistance, abrasion resistance and stain resistance of the paint layer were measured or evaluated, and the results are shown in the same Tables. The test methods are as follows.

(Test Methods)

(1) Appearance

After the paint was coated on the golf ball body, the surface of the coated golf ball was checked by visual observation, and the appearance of the coated golf ball was determined by evaluating the leveling of the appearance. The evaluation criteria are as follows.

Evaluation Criteria

○: The paint layer has good appearance such that it has good smoothness.

Δ: The paint layer has poor smoothness at a portion thereof.

x: The paint layer has poor appearance such that it has poor smoothness.

(2) Impact Resistance of Paint Layer

After a No.5 iron club (I#5) was mounted to a swing robot manufactured by True Temper Co. and each coated golf ball was hit at a head speed of 34 m/sec 150 times repeatedly, the appearance of the golf ball was checked by visual observation, and the impact resistance of the paint layer was determined by evaluating the degree of separation of the paint layer. The evaluation criteria are as follows.

Evaluation Criteria

○○: There is no separation of the paint layer.

○: The separated area of the paint layer is not more than 5%, based on the total paint layer area.

Δ: The separated area of the paint layer is larger than 5% and not more than 20%, based on the total paint layer area.

x: The separated area of the paint layer is larger than 20%, based on the total paint layer area.

(3) Abrasion Resistance of Paint Layer

After each coated golf ball was put in a potato peeler, of which the inner surface is covered with brush, and subjected to brushing treatment for 1 hour, the appearance of the golf ball was checked by visual observation, and the abrasion resistance of the paint layer was determined by evaluating the degree of separation of the paint layer. The evaluation criteria are as follows.

Evaluation Criteria

○○: There is no separation of the paint layer.

○: The separated area of the paint layer is not more than 5%, based on the total paint layer area.

Δ: The separated area of the paint layer is larger than 5% and not more than 20%, based on the total paint layer area.

x: The separated area of the paint layer is larger than 20%, based on the total paint layer area.

(4) Stain Resistance of Paint Layer

In 100 milliliters of water, 50 g of spinach was milled and mixed to obtain a spinach juice. Each coated golf ball was immersed in the spinach juice for 24 hours. The L*a*b* color difference (ΔL*, Δa* and Δb*) of the surface of the golf ball between before and after the immersion was measured by using a color-difference-colorimeter, which is commercially available from Minolta Co., Ltd. under the trade name "CR-221", and was represented by ΔE. The ΔE is determined by using the following formula:

$$\Delta E=[(\Delta L^*)^2+(\Delta a^*)^2+(\Delta b^*)^2]^{1/2}$$

The larger the value of color difference ΔE is, the less the stain (discoloring) resistance is.

(Test Results)

TABLE 3

(parts by weight)

| Paint composition | Example No. 1 | 2 | 3 | 4 | 5 | Com. Ex. No. 1 |
|---|---|---|---|---|---|---|
| (Hardener) | | | | | | |
| Polyisocyanate A *5 | 30 | 25 | 35 | 25 | 32.5 | 40 |
| Polyisocyanate B *6 | 30 | 35 | 25 | 25 | 32.5 | 30 |
| Polyisocyanate C *7 | 40 | 40 | 40 | 50 | 35 | 30 |
| (Solvent) | | | | | | |
| Methyl ethyl Ketone | 40 | 40 | 40 | 40 | 40 | 40 |
| Appearance | ○ | ○ | ○ | ○ | ○ | Δ |
| Impact resistance | ○○ | ○○ | ○○ | ○ | ○○ | ○○ |
| Abrasion resistance | ○○ | ○ | ○○ | ○ | ○○ | ○○ |
| Stain resistance (ΔE) | 12.5 | 12.4 | 12.4 | 11.7 | 12.8 | 18.2 |

TABLE 4

(parts by weight)

| Paint composition | Comparative Example No. 2 | 3 | 4 | 5 | 6 | 7 |
|---|---|---|---|---|---|---|
| (Hardener) | | | | | | |
| Polyisocyanate A *5 | 20 | 30 | 30 | 35 | 27.5 | 75 |
| Polyisocyanate B *6 | 30 | 40 | 20 | 35 | 27.5 | 0 |
| Polyisocyanate C *7 | 50 | 30 | 50 | 30 | 55 | 25 |
| (Solvent) | | | | | | |
| Methyl ethyl Ketone | 40 | 40 | 40 | 40 | 40 | 40 |
| Appearance | ○ | ○ | ○ | ○ | ○ | ○ |
| Impact resistance | ○○ | ○○ | ○○ | ○○ | x | ○○ |
| Abrasion resistance | ○ | ○○ | ○○ | ○○ | ○ | ○○ |
| Stain resistance (ΔE) | 12.4 | 18.3 | 12.5 | 19.3 | 11.9 | 25.2 |

*5: Polyisocyanate A; isocyanurate polyisocyanate derived from hexamethylene diisocyanate commercially available from Sumitomo-Bayer Urethane Co., Ltd. under the trade name of "Desmodule Z-3390"

*6: Polyisocyanate B; biuret polyisocyanate derived from hexamethylene diisocyanate commercially available from Sumitomo-Bayer Urethane Co., Ltd. under the trade name of "Sumidule N-3200"

*7: Polyisocyanate C; isocyanurate polyisocyanate derived from isophorone diisocyanate commercially available from Sumitomo-Bayer Urethane Co., Ltd. under the trade name of "Desmodule Z-4370"

As is apparent from the results of Tables 3 to 4, the coated golf balls of Examples 1 to 5, when compared with those of the golf balls of Comparative Examples 1 to 7, have good appearance, excellent durability after repeated hitting, excellent abrasion resistance after brushing treatment and excellent stain resistance with a grass.

On the other hand, in the golf ball of Comparative Example 1, since the amount of the polyisocyanate A in the curing agent of the paint is large, the leveling is degraded, and the appearance is poor. In addition, since the amount of the polyisocyanate C in the curing agent of the paint is small, the stain resistance is poor. In the golf ball of Comparative Example 2, since the amount of the polyisocyanate A in the curing agent of the paint is small, the abrasion resistance is poor. In the golf ball of Comparative Example 3, since the amount of the polyisocyanate B is large and that of the polyisocyanate C is small in the curing agent of the paint, the stain resistance is poor.

In the golf ball of Comparative Example 4, since the amount of the polyisocyanate B in the curing agent of the paint is small, the leveling is degraded, and the appearance is poor. In the golf ball of Comparative Example 5, since the polyisocyanate C in the curing agent of the paint is small, the stain resistance is poor. In the golf ball of Comparative Example 6, since the amount of the polyisocyanate C in the curing agent of the paint is large, the paint layer is hard and brittle, and the impact resistance at the time of repeated hitting is poor. In the golf ball of Comparative Example 7, since the amount of the polyisocyanate A is large and that of the polyisocyanate B is small in the curing agent of the paint, the leveling is degraded, and the appearance is poor. In addition, since the amount of the polyisocyanate C in the curing agent of the paint is small, the stain resistance is poor.

What is claimed is:

1. A coated golf ball formed by applying a paint on the surface of a golf ball body, wherein the paint comprises polyol containing urethane polyol as a main material and polyisocyanate curing agent, and the curing agent comprises 25 to 35% by weight of isocyanurate polyisocyanate derived from hexamethylene diisocyanate, 25 to 35% by weight of biuret polyisocyanate derived from hexamethylene diisocyanate and 35 to 50% by weight of isocyanurate polyisocyanate derived from isophorone diisocyanate.

2. The coated golf ball according to claim 1, wherein the paint is formed from the main material and curing agent such that an equivalent ratio (NCO/OH) of isocyanate group in the curing agent to hydroxyl group in the main material is within the range of 1.0 to 1.5.

3. The coated golf ball according to claim 1, wherein the paint has a single-layered structure.

4. The coated golf ball according to claim 1, wherein the curing agent comprises 26 to 34% by weight of isocyanurate polyisocyanate derived from hexamethylene diisocyanate, 26 to 34% by weight of biuret polyisocyanate derived from hexamethylene dissocyanate and 37 to 48% by weight of isocyanurate polyisocyanate derived from isophorone diisocyanate.

5. The coated golf ball according to claim 1, wherein the curing agent comprises 27 to 33% by weight of isocyanurate polyisocyanate derived from hexamethylene diisocyanate, 27 to 33% by weight of biuret polyisocyanate derived from hexamethylene diisocyanate and 39 to 46% by weight of isocyanurate polyisocyanate derived from isophorone diisocyanate.

6. The coated golf ball according to claim 1, wherein the paint is formed from the main material and curing agent such that an equivalent ratio (NCO/OH) of isocyanate group in the curing agent to hydroxyl group in the main material is within the range of 1.1 to 1.4.

7. The coated golf ball according to claim 2, wherein the paint has a single-layered structure.

8. The coated golf ball according to claim 6, wherein the paint has a single-layered structure.

9. The coated golf ball according to claim 1, wherein the paint layer has a thickness of 6 to 25 $\mu$m.

10. The coated golf ball according to claim 1, wherein the paint layer has a thickness of 8 to 20 $\mu$m.

* * * * *